United States Patent [19]

Mykkanen

[11] Patent Number: 4,476,514

[45] Date of Patent: Oct. 9, 1984

[54] LINE SPACER

[75] Inventor: C. Fred Mykkanen, Anoka County, Minn.

[73] Assignee: Honeywell Inc., Minneapolis, Minn.

[21] Appl. No.: 411,926

[22] Filed: Aug. 26, 1982

[51] Int. Cl.[3] ..... H05F 3/06

[52] U.S. Cl. ..... 361/213; 174/97; 174/146; 361/229

[58] Field of Search ..... 174/97, 146; 361/213, 361/220, 229, 231, 232

[56] References Cited

U.S. PATENT DOCUMENTS 4,388,667 6/1983 Saureman ..... 361/212 X

FOREIGN PATENT DOCUMENTS 478292 11/1951 Canada ..... 361/213
750448 10/1933 France ..... 174/97
890754 2/1944 France ..... 174/146

*Primary Examiner*—Harry E. Moose, Jr.
*Attorney, Agent, or Firm*—George W. Field

[57] ABSTRACT

A line spacer for a pair of insulated conductors each having conductive points projecting laterally beyond the insulation thereof in a common direction at sites spaced therealong, comprising a block of insulating material having a pair of laterally spaced grooves extending therealong near opposite edges thereof and opening to a first surface of the block, the grooves being deeper than the sum of the conductor diameter added to the point projection, and means severally accessible from the opposite edges of the block for compressively retaining the conductors against motion in said grooves.

13 Claims, 9 Drawing Figures

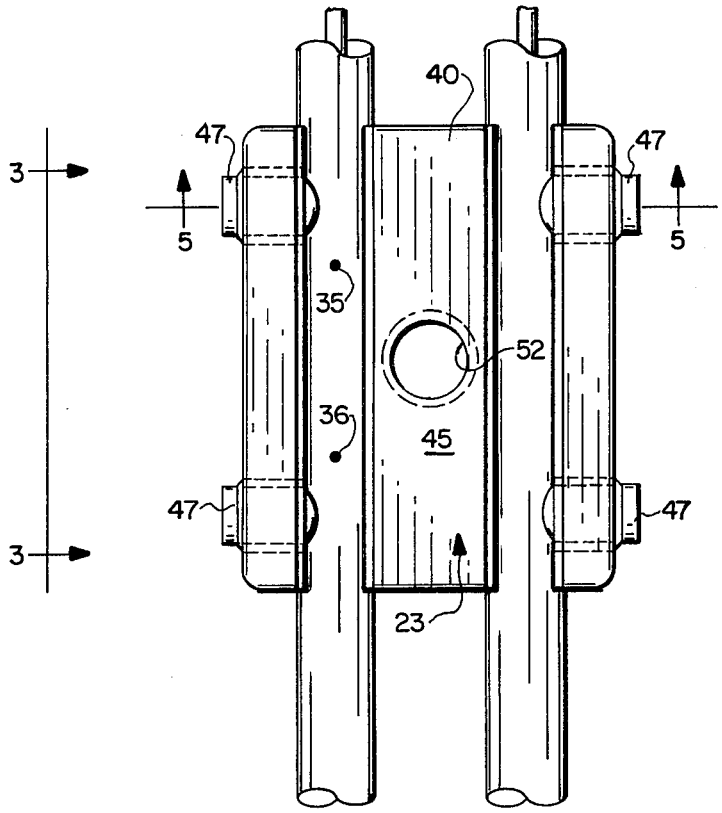
FIG. 2
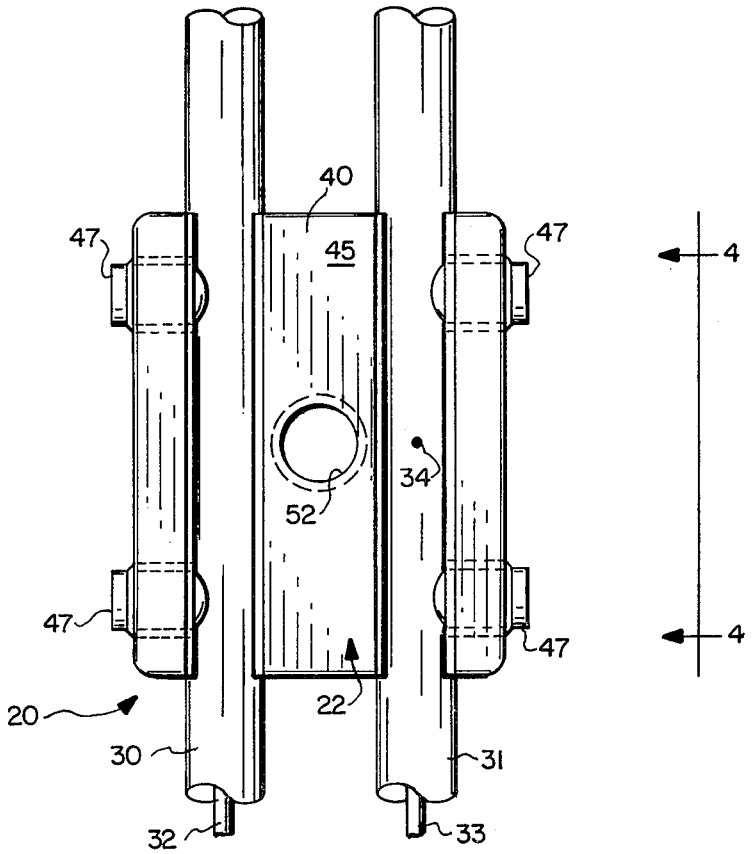

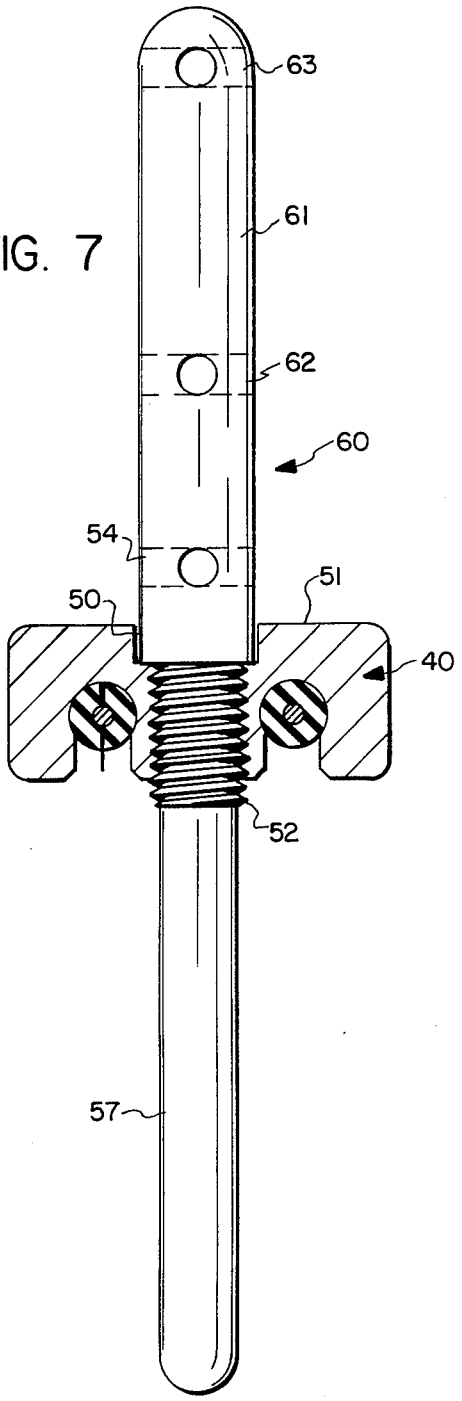
FIG. 7
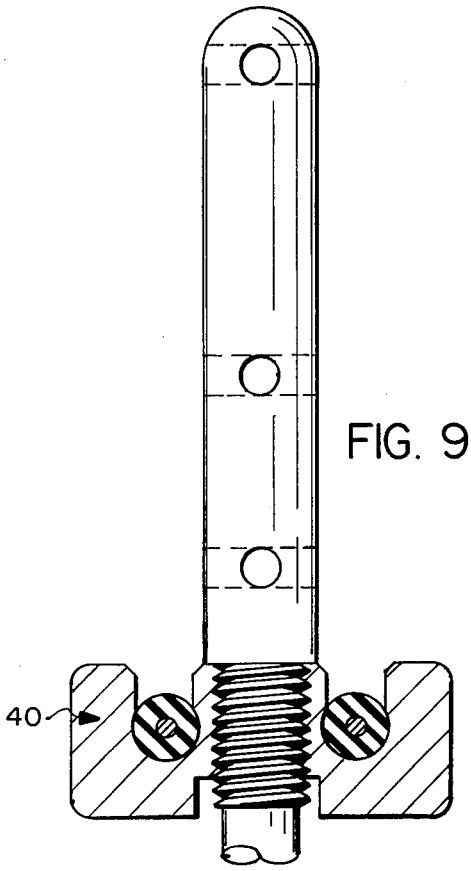
FIG. 9
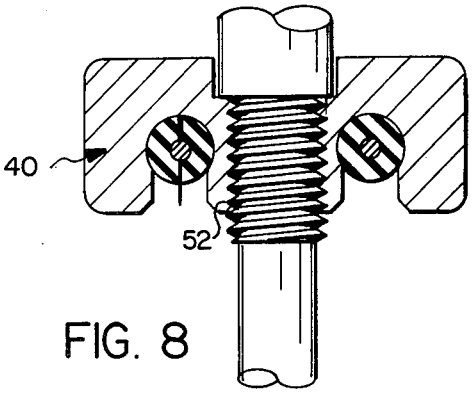
FIG. 8
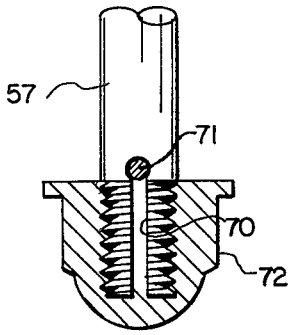

LINE SPACER

TECHNICAL FIELD

This invention relates to the field of condition control of indoor spaces, and more particularly to means for eliminating the undesirable presence of static electricity in spaces used for processing or manufacturing where costly items can be ruined or costly procedures can be impeded by static electricity.

BACKGROUND OF THE INVENTION

It is only comparatively recently that static electricity has been identified as not merely a curious or annoying winter phenomenon, but as a phenomenon unavoidably present in many manufacturing and processing facilities, and capable of causing very great problems. For example, in the manufacture of computer components and other microcircuit "chips", merely the touching of such a unit by a technician who has walked across a carpeted floor may destroy the expensive chip electrically even while the workman does not feel anything. Similar adverse effects are noted in industries where film is handled or processed.

One method of attempting to cope with the problem is to control the humidity of the air in the work space in question. It is known that the greater quantity of moisture in air of high humidity provides more paths for dispersion of static electricity. On the other hand, increased humidity also introduces practical manufacturing problems which become intolerable if the humidity is made excessive. A compromise is reached by maintaining the relative humidity at forty percent, which is higher than that of normal indoor air in the winter for heated buildings, although ambient air frequently becomes more moist in the summer.

As an alternative solution to the problem of static electricity, it has been proposed to ionize the air in the space in question, so that any static charge built up on or carried in by employees or objects moving in the space will be quickly neutralized. To accomplish this, conductors having having discharge points are maintained at high negative and positive potentials, to discharge negative and positive ions into the air above personnel and the tops of tables or desks. It has been found that neutralization of charges on persons entering a space so equipped takes place within approximately 10 seconds of entry, and neutralization at table top level takes place in less than 30 seconds.

However, the handling and installation of conductors equipped to discharge ions is different and often painful because of the numerous sharp points which are present. The necessary handling during installation frequently blunts the points to reduce their efficacy. My invention comprises means for easily and painlessly installing ionization equipment in areas where static electricity is a problem.

SUMMARY OF THE INVENTION

The invention comprises a new line spacer which can be secured to either positive or negative discharge lines to maintain their spacing, to protect the discharge points and the working personnel during installation, and to maintain the electrical insulation of the high voltage conductors involved. The wires as supplied to installing personnel are received in grooves in a succession of spacers which stabilize them against linear or rotary movement, so that the points remain in effective orientation. My spacers may be associated with assemblies removable therefrom, to further facilitate the installation of the conductors, to prevent inadvertent touching of the discharge points, or to support a parallel ground wire.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals identify corresponding elements throughout the several views, FIG. 2 is an enlarged fragmentary view of the portion of the system identified in the broken outline of FIG. 1, to a larger scale.

DESCRIPTION OF THE PREFERRED EMBODIMENTS

Figure 1:
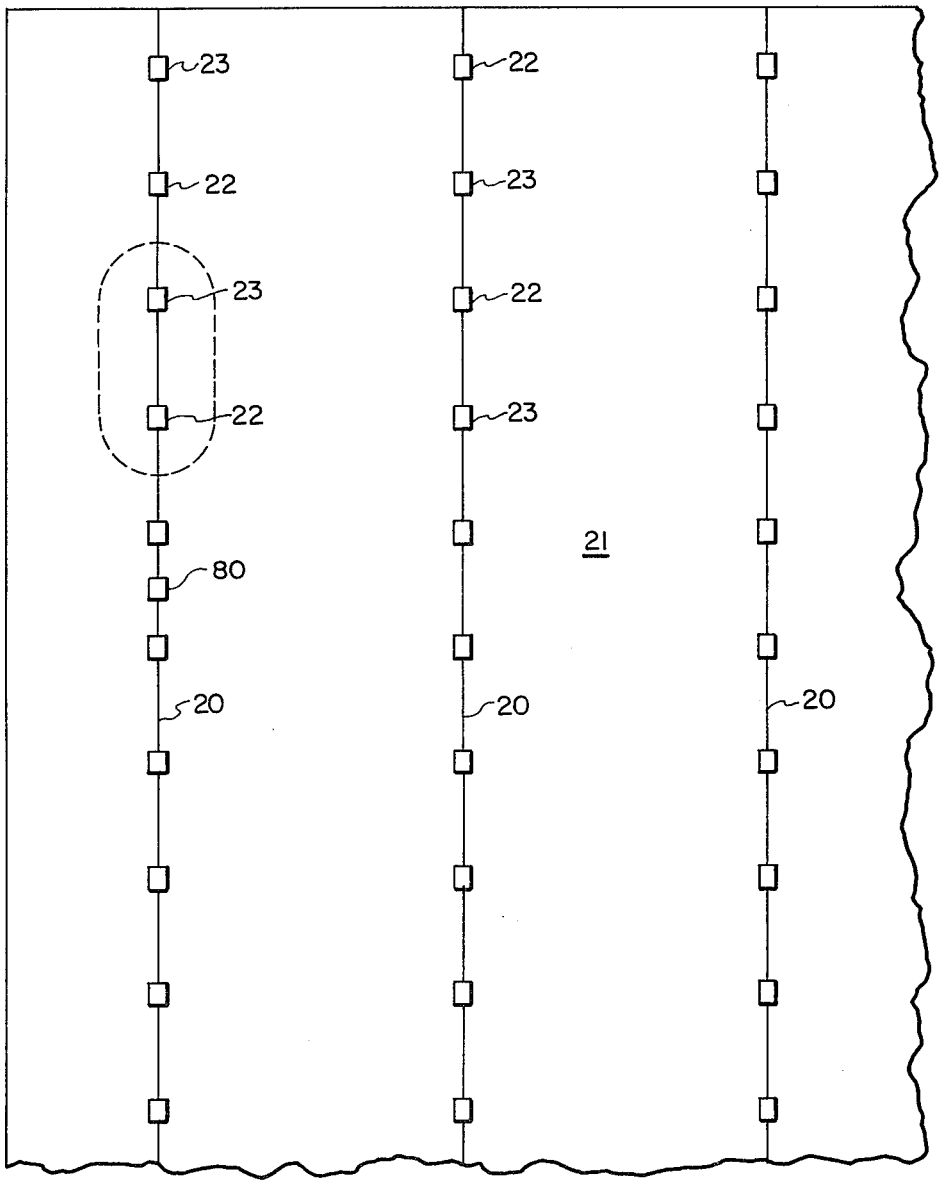
FIG. 1 is a bottom view of a portion of an indoor space in which a room ionization system according to the invention is installed.

FIG. 1 schematically shows an installation for overcoming static electricity in an indoor space. A plurality of dual high-voltage cables 20 are suspended near the ceiling 21 of the space. The cables may be four feet apart transversely. Corona discharge stations 22 and 23 are located alternately along the cables, and may be spaced by sixteen to eighteen inch intervals.

Figure 3:
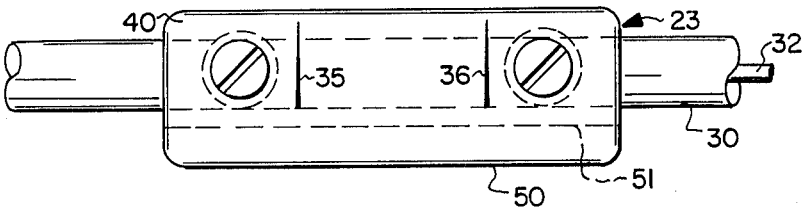
FIGS. 3 and 4 are side views taken along the lines 3—3 and 4—4 of FIG. 2.
Figure 4:
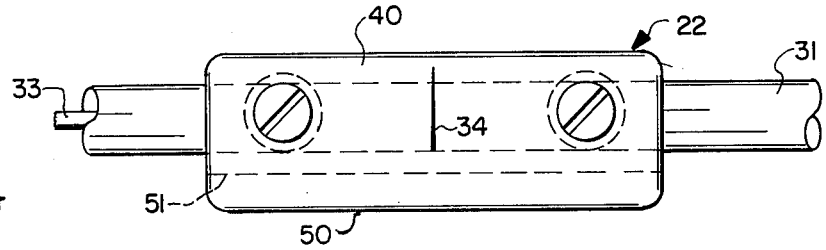
Figure 5:
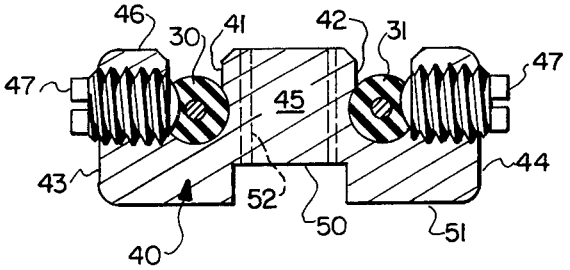
FIG. 5 is a sectional view along the line of 5—5 of FIG. 2, and FIGS. 6–9 show accessories in use with a spacer according to the invention.

As best shown in FIG. 2, each cable 20 comprises a pair of wires 30 and 31, insulated for high voltages, having stranded conductors 32 and 33 connected to 18,000 volt, current limited direct current generators, not shown. Conductor 32 is positive with respect to ground and conductor 33 is negative with respect to ground, so that a potential difference of 36,000 volts exists between the conductors, which may be mutually spaced at $\frac{5}{8}$ inch center to center. For safety and for most efficient operation, cables 20 are located 7 $\frac{1}{2}$ to 8 feet above the floor of the space. At each corona discharge station 22 a needle point 34 passes through stranded conductor 33 and projects laterally downward beyond the insulation of wire 31, as shown in FIG. 4. At each station 23 a pair of needle points 35 and 36, which may be spaced by about 1$\frac{1}{4}$ inches, pass through stranded conductor 33 and project laterally downward beyond the installation of wire 30, as shown in FIG. 3. Points 34 discharge negative ions into the ambient atmosphere, and points 35 and 36 discharge positive ions into the atmosphere. It has been found that possitive ions discharge less abundantly from points than negative ions.

At each discharge station there is located a spacer 40 comprising a block of insulating material having a pair of laterally spaced grooves 41 and 42 extending parallel to and spaced inwardly from opposite edges 43 and 44. The grooves are separated by a ridge 45, and open into a common surface 46 of the block. The grooves are of width to permit wires 30 and 31 to be forced into them, and are slightly enlarged at their bottoms. Oval tip set screws 47 of insulating material are threaded into edges 43 and 44 to compressively retain wires in the grooves, thus maintaining the mutual spacing of about $\frac{5}{8}$ inch and holding the wire so that points 34, 35 and 36 are directed outwardly of the grooves. The points terminate slightly below the surface 46, and are thus protected from damage by abrasion during installation, and are also prevented from tearing or scratching the hands of workmen installing the equipment.

It was pointed out above that the power supplies energizing wires 30 and 31 are current limited, to avoid any possibility of electrical hazard to personnel. However, considering the high voltages necessary for effective ion discharge it is possible for inadvertent approach of a person or a material item too close to a discharge point to draw an arc therefrom, and such arcs, while harmless to personnel, have been found to disable sensitive computers in the area. FIGS. 8, 9, and 10 show how my invention is adapted to help in preventing the occurrence of such arcs, and also to facilitate the installation of ionizing conductors by providing convenient mouting accessories.

Figure 6:
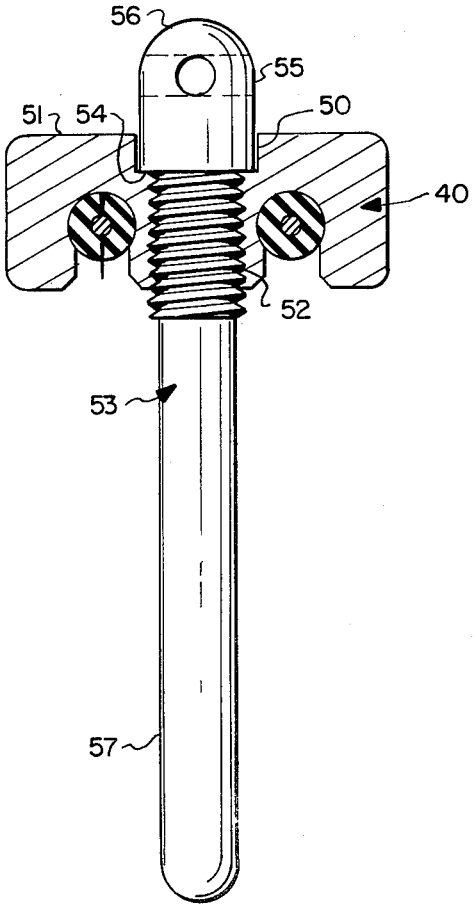

In addition to grooves 41 and 42, each block 40 may have further longitudinal groove 50 formed in the surface 51 of the block opposite surface 46. Centrally, each block 40 is provided with a tapped bore 52 passing through ridge 45 and opening into groove 50, which has a flat bottom. FIG. 6 shows that a touch rod 53 may be screwed into bore 52, to have a shoulder 54 tightened against the bottom of groove 50, by a tool temporarily inserted in a cross bore 55 in an enlarged head 56 of rod 53. The central location of a longitudinally downward portion 57 of the bar acts to prevent most accidental arc-producing approaches to the ion discharge points protected in the block.

It is usually desirable to support the dual cable at points intermediate the ends. For this purpose, a touch and hangar rod 60 may be used. As is shown in FIG. 7, rod 60 has an elongated head 61 with additional cross bores 62 and 63 to receive mounting chains by which the rod and block assembly, and with it the dual cable 20, may be attached to the ceiling. If desired, hanger rod 60 may be extended to include downward touch preventing portion 57.

An alternative which may be used either with touch rod 53 or hanger rod 60 is shown in FIG. 8. It has been found that under some circumstances the effectiveness of the ionization system is improved if a bare ground wire is run parallel to and some six inches below the dual cable. To facilitate this, the outer end of downward extension 57 is split to provide a slot 70, and is externally threaded. A ground wire 71 may be passed through slot 70 and secured there by a nylon cap nut 72. The slot may be aligned with the direction of the wires of cable 20 by variation of the tightness of the threaded connection at 52, so that the ground wire can be conveniently installed after the rest of the installation has been completed. It may not be necessary to support the ground wire at every station.

It frequently happens that ducts, vents, pipes, and similar objects located near the ceiling of space are so positioned as to make it desirable to support cable 20 at a site between two discharge stations, as at a station 80 in FIG. 1. When this is the case, a spacer 20 may be forced onto wires 30 and 31 from below until the wires are received in the groove enlargements, a hanger rod may be threaded into bore 52 of the spacer from the then upper surface 46, (see FIG. 9) and the combination may be slid along the wires to a desired location between stations 22 and 23, to perform the desired support function. For this application set screws 47 are not needed in the spacer.

It has been found convenient to supply spacers 40 in three different colors, for convenience in inspection and maintenance of the system. Spacers to be used for positive station 23 may be red, those for negative stations 22, may be black, and those for support station 80 may be white.

From the above it will be evident that the invention comprises an improved line spacer for ion discharge conductors, which may be attached to the wires by the manufacturer so that the dual cable may be supplied in bulk and installed without danger to the discharge points and without injury to the installing personnel. The spacer is adapted for use with accessory rods to assist in hanging the lines, to minimize arc-producing approach to the ion discharge points, and to facilitate the installation of a ground wire when this is desired.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are as follows:

1. A line spacer for a pair of insulated conductors each having conductive points projecting laterally beyond the insulation thereof in a common direction at sites spaced therealong, comprising a block of insulating material having a pair of laterally spaced grooves extending therealong near opposite edges thereof and opening to a first surface of the block, said grooves being deeper than the sum of the conductor diameter added to the point projection, and means severally accessible from said opposite edges for compressively retaining said conductors against motion in said grooves.

2. A spacer accordingly to claim 1 in which said grooves have enlarged bottoms, and in which the last named means comprises set screws of insulating material threaded into said opposite edges in line with said bottoms of said grooves to laterally engage conductors extending therethrough.

3. A spacer accordingly to claim 2 in which pairs of said set screws are located at sites mutually spaced along each of said opposite edges.

4. In combination, a line spacer according to claim 1 and means removably secured thereto for preventing inadvertent arc-producing contact with said conductive points.

5. In combination, a line spacer according to claim 1 and means removably secured thereto for supporting said spacer from a direction orthogonal to the direction of said conductors.

6. In combination, a line spacer according to claim 1, and means removably secured thereto for supporting said spacer and for preventing inadvertent arc-producing contact with said conductor points.

7. In combination, a line spacer according to claim 1 and means removably secured thereto for supporting a further conductor at a desired distance from said insulated conductors.

8. In combination, a line spacer according to claim 1 and means removably secured thereto for supporting a further conductor at a desired distance from said insulated conductors, and for preventing inadvertent arc-producing contact with said conductive points.

9. In combination, a line spacer according to claim 1, and means removably secured thereto for supporting said spacer, for supporting a further conductor at a desired distance from said insulated conductors, and for preventing inadvertent arc-producing contact 10. In combination:

a conductor having a conductive point projecting laterally beyond the insulation thereof;

a block of insulating material having a groove extending therealong near an edge thereof and opening to a first surface thereof, the groove being deeper than the sum of the conductor diameter added to the point projection, said groove having an enlarged bottom;

and a pair of set screws of insulating material threaded into said edge of said block at mutually spaced sites therealong, in line with the bottom of said groove, to engage said conductor in said bottom of said groove laterally at sites displaced from the location of said point, for preventing linear and rotary movement of said conductor in said block.

11. In combination:

a conductor having a pair of mutually spaced conductive points projecting laterally beyond the insulation thereof in a common direction;

a block of insulating material having a groove extending therealong near an edge thereof and opening to a first surface thereof, the groove being deeper than the sum of the conductor diameter added to the point projection, said groove having an enlarged bottom, and a pair of set screws of insulating material threaded into said edge of said block in line with the bottom of said groove, at sites mutually spaced by a distance greater than the spacing between the points of each pair, to engage said conductor in said bottom of said groove laterally at sites between which both points of said pair are located, for preventing linear and rotary movement of said conductor in said block.

12. In combination:

a first conductor having a conductive point projecting laterally beyond the insulation thereof;

a second conductor having a pair of mutually spaced conductive points projecting laterally beyond the insulation thereof in a common direction;

a block of insulating material having first and second laterally spaced grooves extending therealong near first and second opposite edges thereof and opening to a first surface of the block, said grooves being deeper than the sum of the diameter of a conductor added to the projection of a point there beyond, and said grooves having enlarged bottoms;

and pairs of set screws of insulating material threaded into the edges of said block at mutually spaced sights therealong in line with the bottom of said grooves to engage said first conductor laterally, at the bottom one of said grooves, at sites displaced from the location of said point, and to engage said second conductor laterally, at the bottom of the other of said grooves, whereby to prevent linear and rotary movement of said conductors in said block.

13. In combination:

a first conductor having conductive points projecting laterally beyond the insulation thereof in a common direction at sites having a uniform spacing therealong;

a second conductor having pairs of mutually spaced conductive points projecting laterally beyond the insulation thereof, in a common direction, at sites having said uniform spacing therealong;

first and second line spacers each comprising a block of insulating material having first and second laterally spaced grooves extending therealong near opposite edges thereof and opening to a first surface of the block, said grooves being deeper than the sum of the conductor diameter added to the point projection, and having enlarged bottoms;

and first and second pairs of set screws of insulating material threaded into said edges at mutually spaced sites therealong in line with the bottom of said grooves, said first and second conductors being received in the bottoms of said first and second grooves in said first and second spacers, said first pair of set screws in said second spacer and said second pair of set screws in said first spacer securing said first and second conductors in said second and first grooves respectively, said first pair of set screws in said first spacer engaging said first conductor at sites oppositely displaced from the location of one of said points, and said second pair of said screws in said second spacer engaging said second conductor at sites between which both points of a pair thereof are located.

* * * * *